United States Patent [19]

von Holdt

[11] Patent Number: 4,574,974

[45] Date of Patent: Mar. 11, 1986

[54] CONTAINER HAVING A SNAP-ON LID

[76] Inventor: John W. von Holdt, 7430 N. Croname Rd., Niles, Ill. 60648

[21] Appl. No.: 681,883

[22] Filed: Dec. 14, 1984

[51] Int. Cl.[4] ..... B65D 41/16; B65D 41/18

[52] U.S. Cl. ..... 220/306; 150/55

[58] Field of Search ..... 220/306, 307, 353, 355, 220/356, DIG. 12, DIG. 14, DIG. 27; 150/55

[56] References Cited

U.S. PATENT DOCUMENTS

| | | | |
|---|---|---|---|
| 4,210,258 | 7/1980 | von Holdt | 220/306 |
| 4,225,045 | 9/1980 | Rayner et al. | 220/306 |
| 4,408,698 | 10/1983 | Ballester | 220/306 |

*Primary Examiner*—George T. Hall

*Attorney, Agent, or Firm*—Charles F. Pigott, Jr.

[57] ABSTRACT

A molded plastic container having a snap-on lid which is affixed to an external undercut on the lip of the container. A second internal undercut engaging the lid structure is also provided. An internal flange is formed within the container adjacent its mouth and creates a pocket in which a plurality of reinforcement ribs are positioned. The ribs may alternatively be diagonal or radial in orientation. The lid structure includes an annular pocket in which radial, crossing, or diagonal strengthening ribs may also be provided.

15 Claims, 10 Drawing Figures

CONTAINER HAVING A SNAP-ON LID

BACKGROUND OF THE INVENTION

This invention relates to improved plastic containers having enhanced strength characteristics and optimum sealing of its internal contents. The containers herein disclosed may be molded through economical molding techniques and used as containers for paint, motor oil or other liquids and material in a wide range of sizes from less than a quart to larger containers of more than five gallons. Superior sealing and strength characteristics are attained by the designs of the invention through novel retention of the lid and/or through use of a plurality of reinforcing ribs formed either in the container mouth or in the lid, or in both the container and the lid for a combined effect.

In recent years, plastic containers are being increasingly used for a wide range of liquids and chemicals which traditionally were filled in metal cans and the like. Some of the important objectives in plastic container designs have been to insure that the structure equals or exceeds the ability of the metal can to prevent leakage, resist forces, and maintain retention of the lid under encountered conditions. Many prior plastic containers have failed to satisfy these and other objectives because of inadequate strength of the mouth portion of the container and of the lid. Such unsatisfactory designs are unable to maintain dimensional rigidity as required for optimum sealing and resistance to hoop and radial stresses. For example, it is desirable that the mouth of the container maintains a circular configuration to aid in sealing of the lid and to insure that the container may be filled by conventional high speed filling machines, an important objective.

DESCRIPTION OF THE INVENTION

In accordance with this invention, several embodiments of containers are provided having an open mouth proportioned to receive a snap-on lid. A typically straight annular flange extends inwardly from the inner wall of the container about its circumference adjacent the mouth. The flange extends toward the open mouth at an angle of essentially 10°-60° to the inner wall, to define an annular pocket between the flange and the inner wall.

The annular pocket is provided with a series of ribs which, according to the particular embodiment, are arranged between the pocket and inner wall in integral relationship thereto. The ribs are provided to increase the strength of the mouth dependent on the objectives to be attained. In one embodiment straight radial ribs are utilized to provide an optimum level of radial force resistance at the mouth of the container, which is desirable for certain applications and designs.

For other conditions, diagonal ribs are arranged in the annular pocket at angle to a radial direction to increase hoop strength as well as to contribute radial strength. The diagonal ribs thus provide a more three dimensional resistance to applied forces.

The lid of the invention may also be formed with an annular pocket and receive strengthening ribs of a similar design as provided on the container. The ribs may be disposed at an angular diagonal orientation, in a crossing pattern, or in a straight radial direction. The ribs on the lid not only strengthen the cover member, but strengthen the combined lid-container structure in a closed configuration.

The rim of the mouth of the containers herein disclosed is formed by an enlarged annular projection having at least an outer undercut to form a shoulder to engage the lid externally in a snapped-on relationship. In one embodiment of the invention, an undercut is further provided internally of the mouth to form a downward facing shoulder to engage the lid in a dual snap-on relationship with the outer undercut for still a greater retention where conditions dictate.

The containers herein demonstrate improved strength characteristics and resistance to radial and/or hoop forces and superb sealing through designs economically capable of being used with existing filling equipment. Further, the invention is capable of being formed by common molding techniques, instead of being limited to fabrication by more expensive methods, such as by use of collapsible molds and the like.

DESCRIPTION OF THE PREFERRED EMBODIMENTS

Figure 1:
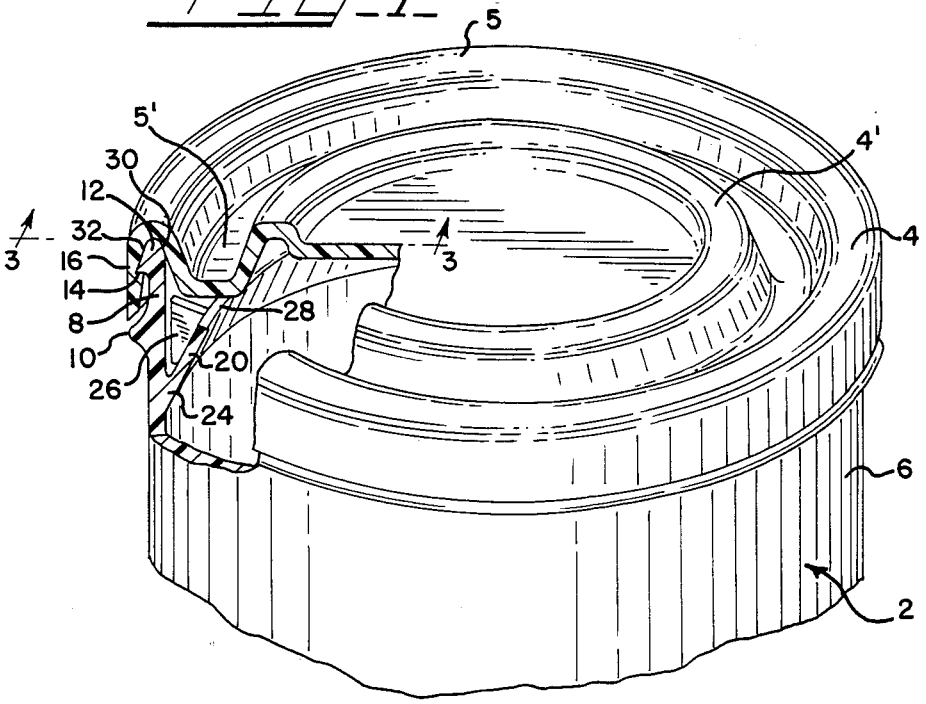
FIG. 1 is a perspective view, with parts in section, of a first embodiment of a container in accordance with this invention.
Figure 2:
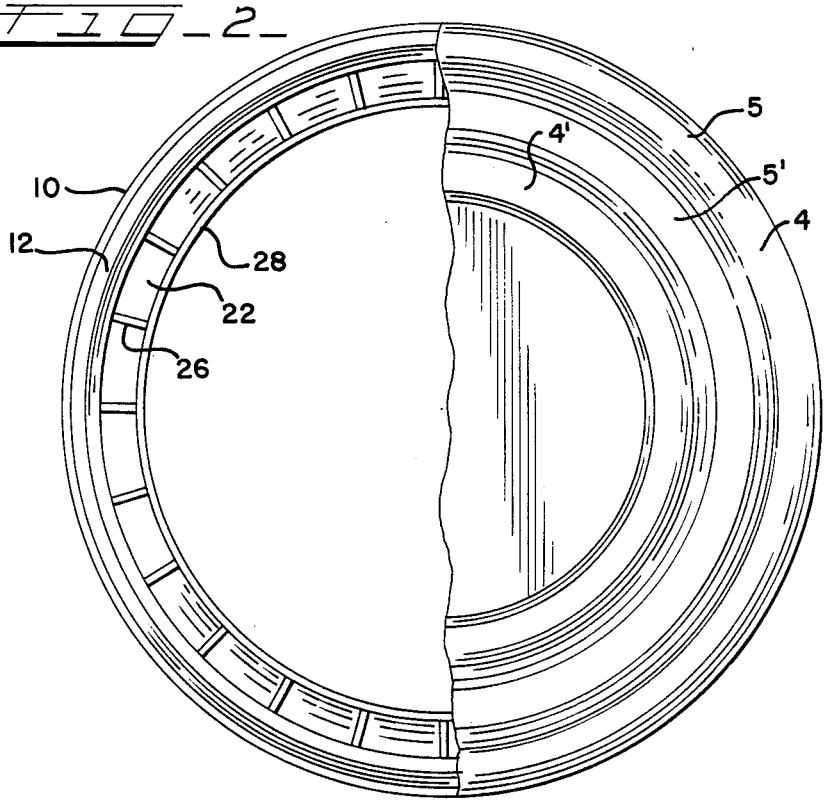
FIG. 2 is a top plan view, with a portion of the lid removed, of the container of FIG. 1.
Figure 3:
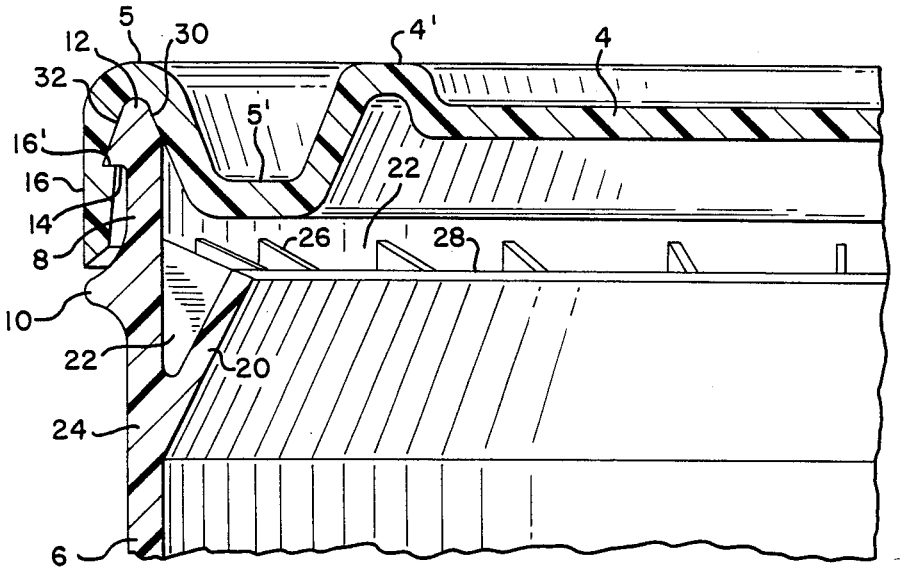
FIG. 3 is an enlarged partial sectional view of the container of FIG. 1 taken along line 3—3 thereof.

Referring now to FIGS. 1, 2 and 3, a first embodiment of the invention is disclosed directed to a plastic container and lid for receiving liquids or chemicals, such as paint, and many other materials.

Container 2 may be molded by any suitable process and forms a generally straight wall plastic structure. Container 2 has an open mouth and is proportioned to receive a snap-on lid 4 to seal the mouth. Snap-on lid 4 is also constructed from plastic and includes a raised central annular section 4'. Lid 4 is provided with an outer portion 5 that is arranged to snap on to the lip portion of the container 2, as will be explained. Annular portion 4*a* and outer portion 5 border a depressed area to create an annular pocket 5' on the top of lid 4.

Container 2 includes a lower wall portion 6 of approximate constant thickness and an upper wall portion 8 surrounding the mouth of the container. An annular flange 10 is circumferentially arranged about the exterior of the container 2 to provide additional strength at the mouth area. An enlarged annular projection 12 forming the lip of the container is provided with an external undercut 14 providing a downward facing shoulder. In the closed position of the lid shown in FIGS. 1, 2 and 3, an outer annular flange 16 extends downward around upper wall portion 8 and is provided with an internal, upwardly facing continuous shoulder 16'. Outer annular portion 16 of lid 2 is sufficiently flexible to permit its shoulder 16' to snap into firm resilient retention against external undercut 14.

An annular flange 20 of a generally straight construction projects inwardly from side wall 6 and defines a continuous annular pocket 22. Annular flange 20 is integrally formed on annular side wall 6 at a thickened wall portion 24, as best seen in FIGS. 1 and 3. A plurality of spaced radially extending reinforcing ribs 26 are arranged around the mouth of container 2 within pocket 22. The ribs 26 extend upward for a height approximately equaling the depth of pocket 22 as established by the upper edge 28 of annular flange 20, and are integrally attached to upper wall portion 8 and annular flange 20. By virtue of the configuration of pocket 22, the ribs 26 in an elevational view possess an approximate triangular shape. It has been found that the presence of annular flange 20 and ribs 26 attain reliable sealing with a structure exhibiting superb resistance to radial forces.

As seen in FIG. 3, upper edge 28 of annular flange 20 terminates at a position beneath the mouth of container 2 and lies in spaced relationship to lid 4. As a result, sealing between lid 4 and lip 12 of the container is greatly contributed through contact at interfaces 30, 32 between the lid and the enlarged annular lip portion 12. The lid 4 is maintained in sealed relationship while engaged with undercut 14, because of the superior resistance to forces of the design of the invention. The improved sealing and retention of lid 4 is attained with a configuration which does not interfere with standard filling machines.

Figure 4:
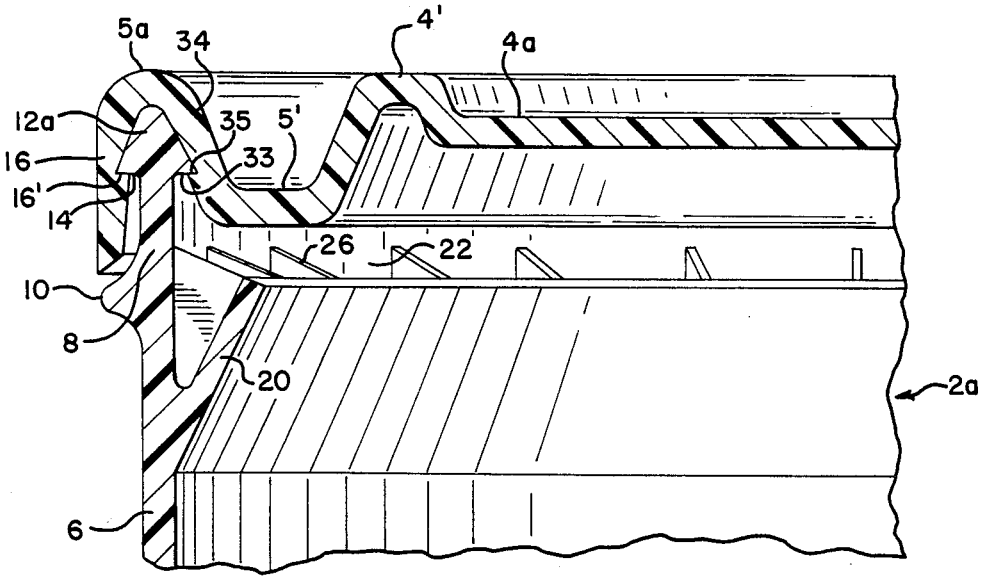
FIG. 4 is a partial sectional view of a second embodiment of the invention similar to the first embodiment as shown in FIG. 3 and having an additional internal undercut for securement of the lid.

In FIG. 4, there is shown another embodiment of the container of the invention generally similar in many respects to the container of the embodiment of FIGS. 1–3. As in the previous embodiment, container **2*a* includes an annular lower side wall 6, an upper wall portion 8, and an external annular flange 10. The embodiment of FIG. 4 includes an enlarged annular lip portion 12*a* having a modified configuration for enhanced retention of the lid to the mouth of container 2*a*. Lip 12*a* is formed with both an external annular undercut 14 to form a downward facing shoulder, and an internal undercut 33 to form a downward facing shoulder within the mouth of container 2**.

Outer portion **5*a* of lid 4*a* is formed with a straight annular wall section 34 having a ledge 35 that provides an upward facing surface to engage internal undercut 33 within the mouth. The embodiment of FIG. 4 accordingly provides dual internal and external resilient snap-on engagement between the lid and the lip of container 2 for increased retention of the lid. The embodiment of FIG. 4** is also capable of being filled by standard filling machines.

Figure 5:
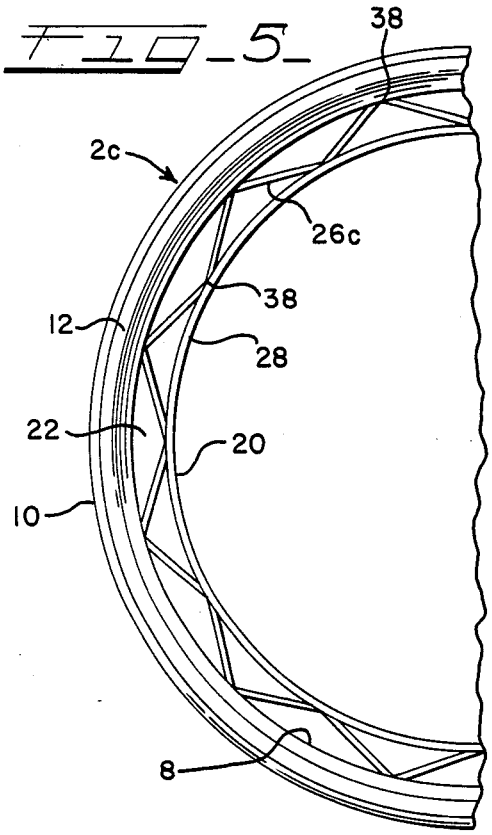
FIG. 5 is a partial top plan view of still another embodiment of the invention utilizing diagonal ribs at the mouth of the container.
Figure 5A:
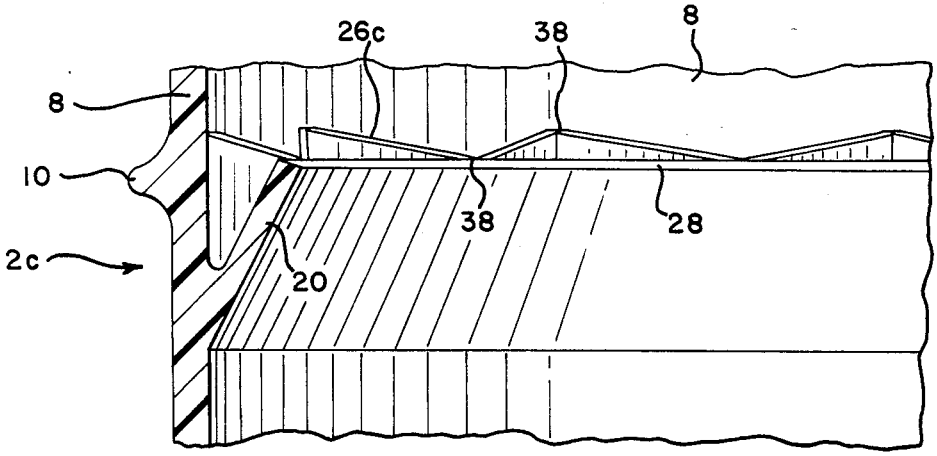
FIG. 5*a* is a partial elevational view, with parts in section, of the container of FIG. 5.

FIGS. 5 and **5*a* show still another embodiment of the improved container of the invention. The embodiment of FIGS. 5 and 5*a* can be used with either the single external retention of the lid to the mouth of the container, as shown in the embodiment of FIGS. 1–3, or with the dual internal and external retention of the lid as in FIG. 4. In FIGS. 5 and 5*a*, diagonal ribs 26*c* are arranged within the pocket 22 in integral relationship to side wall 8 and annular flange 20 and have an elevational configuration similar to ribs 26 of the preceding designs. Diagnonal ribs 26*c* are angularly oriented to a radial direction at any selected angle. The angular orientation allows adjacent ribs 26*c* to form common connecting junctions 38 on side wall 8 or flange 20. It is also within the scope of the invention to join adjacent ribs 26*c* at spaced points of attachment (not shown) to upper wall portion 8 and flange 20, if desired. Diagonal ribs 26*c*** not only contribute to an increased resistance to radial forces, but further provide greatly enhanced hoop strength at the mouth to maintain circular configuration for enhanced sealing and lid retention.

Figure 6:
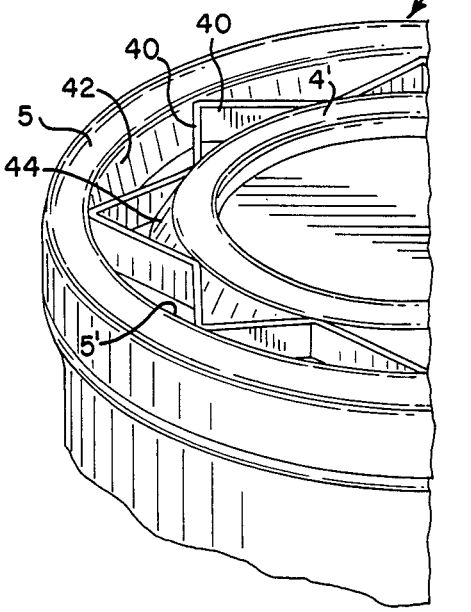
FIG. 6 is a partial perspective view of another embodiment of the invention utilizing diagonal ribs in the lid.
Figure 7:
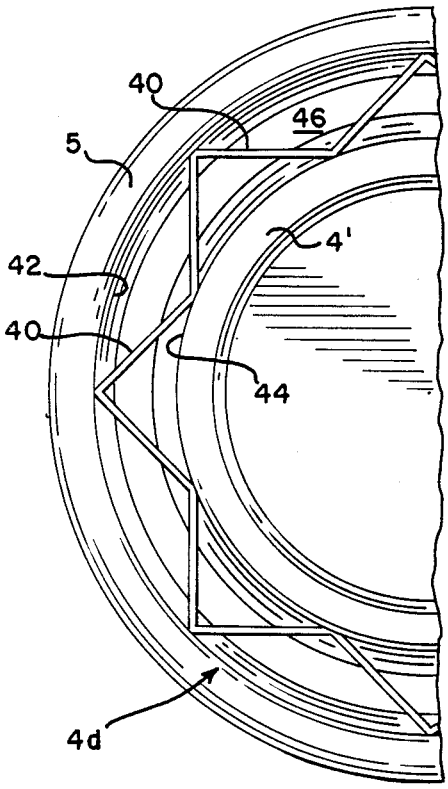
FIG. 7 is a top plan view of the embodiment of the containter of FIG. 6.

In FIGS. 6 and 7, there is shown still another embodiment of the invention having a modified lid **4*b* in which ribs 40 are arranged within annular pocket 5'. The ribs in FIGS. 6 and 7 are integrally retained on the lid respectively to annular wall 42 of outer lid portion 5, annular wall 44 of the annular raised portion 4', and bottom wall 46 of the pocket 5'. As seen in FIGS. 6 and 7, the ribs 40 extend in a diagonal arrangement in a similar manner as the ribs 26*c* in pocket 22 shown in FIG. 5. Diagonal ribs 40 not only increase the radial strength of lid 4*b*, but also enhance hoop strength. The provision of ribs 40 on lid 4*b* also contributes to increased sealing and retention of the lid to the mouth of container 2 as a result of its greater rigidity. Diagonal ribs 40 of the embodiment of FIGS. 6 and 7 on lid 4*b* can be adapted for use with either of the embodiments of FIGS. 1–3 or FIG. 4, whether the container employs the radial ribs 26 shown in FIGS. 1–4 or the diagonal ribs 26*c* of FIG. 3. It is also within the scope of the invention to join a respective rib 40 to walls 42 and 44 in spaced relationship to the point of junction of its adjacent pairs of ribs 40**.

Figure 8:
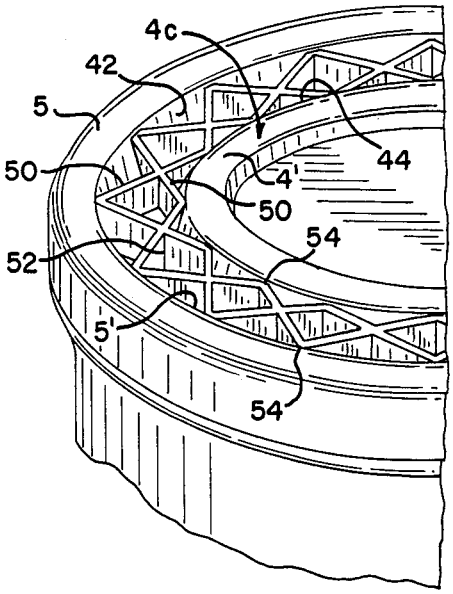
FIG. 8 is a partial perspective view of still another embodiment of the invention utilizing crossing diagonal ribs in the lid.
Figure 9:
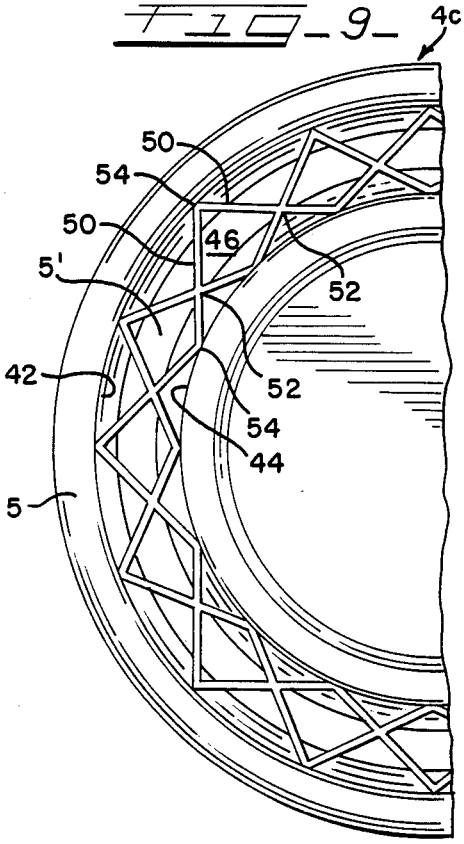
FIG. 9 is a top plan view of the container of FIG. 8.

Referring to FIGS. 8 and 9, a modified lid **4*c* having variations of rib structure is shown. In FIGS. 8 and 9, lid 4*c* includes a plurality of ribs 50 arranged in a crossing pattern for still increased strength of the lid and container structure. The crossing ribs 50 intersect at points 52 approximately midway of the annular pocket 5'. The ribs 50 are respectively attached to annular lid walls 42 and 44 at points 54 and to bottom wall 46 within pocket 5'. Ribs 50 thus span the width of pocket 5' for approximately its entire height to provide optimum hoop and radial strength. As in the case of the embodiment of FIGS. 6 and 7, the crossing rib pattern of FIGS. 8 and 9 may be employed with any of the preceding variations of the invention illustrated and described with reference FIGS. 1–5. The cross rib pattern in FIGS. 8 and 9 can also be employed as reinforcing ribs in pocket 22 of the mouth of container 2**, if desired.

I claim:

1. A molded plastic container comprising a continuous wall having an annular lip defining the mouth of the container;

an inwardly and upwardly extending annular flange forming a pocket on said wall beneath said mouth; and a plurality of reinforcing ribs integral within said pocket between said flange and said wall for increased strength of said mouth.

2. The container according to claim 1 wherein said ribs extend outward in a generally radial direction from the vertical centerline of said container.

3. The container according to claim 1 wherein said ribs extend between said wall and said flange in a diagonal direction.

4. The container according to claim 3 wherein adjacent diagonal ribs extend between said wall and said flange along intersecting axes.

5. The container according to claim 3 wherein adjacent diagonal ribs have generally common positions of attachment to said wall and said flange.

6. The container according to claim 1 wherein said annular lip is formed with an enlarged configuration having an external annular undercut for providing a shoulder to engage a lid for retention.

7. The container according to claim 6 wherein said annular lip further includes an internal undercut for providing a shoulder to further engage the lid for dual retention of the lid.

8. The container according to claim 6 further comprising a lid having an outer annular portion, an annular shoulder formed in said annular portion for resiliently engaging said external shoulder of said annular lip for snap-on retention of the lid.

9. The container according to claim 8 wherein said lid includes an annular pocket between adjacent walls, a plurality of reinforcing ribs integrally disposed between said walls.

10. The container according to claim 9 wherein said ribs extend between said walls in a diagonal pattern.

11. The container according to claim 9 wherein said ribs are disposed in said pockets in diagonal directions with pairs intersecting each other.

12. A lid for a molded plastic container comprising an outer annular portion arranged to engage the mouth of the container in a snap-on relationship, said outer portion having a first annular wall;

a central portion spaced within said central annular portion and having a second wall;

said first and second walls forming an annular pocket;

a plurality of ribs respectively disposed in integral retention between said walls;

said plurality of ribs extending in a diagonal direction between said walls at an angle to the radius of the lid and adjacent pairs of said plurality of ribs lying in intersecting relationship to each other.

13. The lid according to claim 12 wherein said adjacent pairs of said plurality of ribs lie in intersecting relationship to each other.

14. A molded plastic container as defined in claim 13 where said ribs extend outwardly in a generally radial direction from the vertical center line of said container.

15. A molded plastic container as defined in claim 13 where said ribs extend between said wall and said flange in a diagonal direction.

* * * * *